US007932877B2

(12) United States Patent
Tanada et al.

(10) Patent No.: US 7,932,877 B2
(45) Date of Patent: Apr. 26, 2011

(54) DISPLAY DEVICE AND ELECTRONIC APPARATUS

(75) Inventors: Yoshifumi Tanada, Atusugi (JP); Tadafumi Ozaki, Gifu (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 1359 days.

(21) Appl. No.: 11/280,727

(22) Filed: Nov. 17, 2005

(65) Prior Publication Data

US 2006/0109215 A1 May 25, 2006

(30) Foreign Application Priority Data

Nov. 24, 2004 (JP) ..... 2004-339682

(51) Int. Cl.
*G09G 3/30* (2006.01)

(52) U.S. Cl. ..... 345/76; 345/98; 345/99; 345/100

(58) Field of Classification Search ..... 345/76–100, 345/204–215, 690; 315/169.1–169.4
See application file for complete search history.

(56) References Cited

U.S. PATENT DOCUMENTS

| | | | | |
|---|---|---|---|---|
| 5,247,190 | A | 9/1993 | Friend et al. | |
| 5,399,502 | A | 3/1995 | Friend et al. | |
| 5,615,027 | A | 3/1997 | Kuribayashi et al. | |
| 5,767,832 | A | 6/1998 | Koyama et al. | |
| 5,990,629 | A | 11/1999 | Yamada et al. | |
| 6,310,600 | B1 | 10/2001 | Koyama et al. | |
| 6,329,973 | B1 * | 12/2001 | Akimoto et al. | 345/98 |
| 6,583,775 | B1 | 6/2003 | Sekiya et al. | |
| 6,614,418 | B2 | 9/2003 | Koyama et al. | |
| 6,774,574 | B1 * | 8/2004 | Koyama | 315/169.3 |
| 6,777,887 | B2 | 8/2004 | Koyama | |
| 7,423,623 | B2 | 9/2008 | Akimoto et al. | |
| 2001/0022565 | A1 | 9/2001 | Kimura | |
| 2002/0024496 | A1 | 2/2002 | Akimoto et al. | |
| 2002/0135556 | A1 | 9/2002 | Nakajima et al. | |

(Continued)

FOREIGN PATENT DOCUMENTS

| | | |
|---|---|---|
| EP | 0 852 371 | 7/1998 |

(Continued)

OTHER PUBLICATIONS

Search Report (European Patent Application No. 05025577.7) dated Aug. 28, 2008, 11 pages.

(Continued)

*Primary Examiner* — Vijay Shankar
(74) *Attorney, Agent, or Firm* — Fish & Richardson P.C.

(57) ABSTRACT

The invention provides a display device and an electronic apparatus which can reduce power consumption in the case of being driven by using a digital time grayscale method. According to the invention, a row in which all the pixels display black is focused on in a plurality of pixels arranged in matrix, and sampling of data which is to be inputted to the pixels arranged in the row is not performed. Then, in a period during which the data sampling is not performed, the operation of a shift register in a source driver and sampling operation of a video signal in a first latch circuit are stopped. The invention which has the aforementioned characteristics can temporally stop operation of the source driver to reduce power consumption. In particular, the invention can stop operation of the source driver which consumes much power in the display device, leading to dramatic reduction in power consumption.

27 Claims, 8 Drawing Sheets

U.S. PATENT DOCUMENTS

| | | | | |
|---|---|---|---|---|
| 2002/0153844 | A1 | 10/2002 | Koyama | |
| 2003/0197472 | A1 * | 10/2003 | Kanauchi et al. | 315/169.1 |
| 2004/0140972 | A1 | 7/2004 | Hirota et al. | |
| 2004/0207331 | A1 | 10/2004 | Koyama | |

FOREIGN PATENT DOCUMENTS

| | | | |
|---|---|---|---|
| EP | 1 063 630 | A2 | 12/2000 |
| JP | 2001-005426 | | 1/2001 |
| JP | 2001-324958 | | 11/2001 |
| WO | 90/13148 | A1 | 11/1990 |

OTHER PUBLICATIONS

Schenk.H et al., "Polymers for Light Emitting Diodes,", Eurodisplay '99 : The 19th International Display Research Conference, Sep. 6, 1999, pp. 33-37, in English.

Shimoda.T et al., "High Resolution Light Emitting Polymer Display Driven by Low Temperature Polysilicon Thin Film Transistor With Integrated Driver,", Asia Display '98 : Proceedings of the 18th IDRC (International Display Research Conference), 1998, pp. 217-220, in English.

Baldo.M et al., "Very High-Efficiency Green Organic Light-Emitting Devices Based on Electrophosphorescence,", Appl. Phys. Lett. (Applied Physics Letters, Jul. 5, 1999, vol. 75, No. 1, pp. 4-6, in English.

Tsutsui.T et al., "High Quantum Efficiency in Organic Light-Emitting Devices With Iridium-Complex as a Triplet Emissive Center,", Jpn. J. Appl. Phys. (Japanese Journal of Applied Physics) , Dec. 15, 1999, vol. 38, No. 12B, pp. L1502-L1504, in English.

Kimura.M et al., "TFT-LEPD With Image Uniformity by Area Ratio Gray Scale,", Eurodisplay '99 : The 19th International Display Research Conference, Sep. 6, 1999, pp. 71-74, in English.

Shimoda.T et al., "Technology for Active Matrix Light Emitting Polymer Displays,", IEDM 99: Technical Digest of International Electron Devices Meeting, 1999, pp. 107-110, in English.

Shimoda.T et al., "Current Status and Future of Light-Emitting Polymer Display Driven by Poly-Si TFT,", SID Digest '99 : SID International Symposium Digest of Technical Papers, May 18, 1999, vol. 30, pp. 372-375, in English.

Han.C et al., "3.8inch Green OLED with Low Temperature Poly Si TFT,", Eurodisplay '99 : The 19th International Display Research Conference, Sep. 6, 1999, pp. 27-30, in English.

Kimura.M et al., "Low-Temperature Poly-Si TFT Driven Light-Emitting-Polymer Displays and Digital Gray Scale for Uniformity ,", IDW '99 : Proceedings of the 6th International Display Workshops, 1999, pp. 171-174, in English.

* cited by examiner

DISPLAY DEVICE AND ELECTRONIC APPARATUS

BACKGROUND OF THE INVENTION

1. Field of the Invention

The present invention relates to a display device which has a plurality of pixels arranged in matrix, and to an electronic apparatus using the display device. More specifically, the invention relates to a display device which controls each pixel by inputting a video signal to a selected pixel and displays an image, and to an electronic apparatus using the display device.

2. Description of the Related Art

Demand for a dot matrix display device such as a liquid crystal display device has rapidly increased not only for stationary applications such as a TV receiver and a display for a personal computer but also for mobile applications. In recent years, an EL display device which has a pixel including an organic electroluminescence element (hereinafter referred to as an organic EL) has started to be put into practical use as a next generation display device substituted for the liquid crystal display device.

In general, a dot matrix display device has a passive matrix type and an active matrix type. There are an analog grayscale method and a digital grayscale method as a method for achieving grayscale in an active matrix display device. In the analog grayscale method, grayscale is achieved by controlling the luminance of a pixel. In the digital grayscale method, each pixel is controlled by two values depending on whether light is emitted or not. The grayscale is achieved in accordance with the size of a light emitting area or the length of a light emitting time in a certain period. The former is called an area grayscale method and the latter is called a time grayscale method.

In the aforementioned time grayscale method, one frame period is divided into a plurality of subframe periods to weight the light emitting time in each subframe period. Then, in accordance with a combination of the subframe periods, luminance per one frame period is controlled to achieve grayscale. Patent Documents 1 and 2 disclose one of the methods for achieving multi-grayscale in this manner.

[Patent Document 1] Japanese Patent Laid-Open Publication No. 2001-5426

[Patent Document 2] Japanese Patent Laid-Open Publication No. 2001-324958

SUMMARY OF THE INVENTION

According to Patent Document 2, in the case of, for example, a 6-bit (64-level grayscale) display, one frame period is divided into six subframe periods (SF1 to SF6) and the length of a light emitting period in each subframe period is set to $2^5:2^4:2^3:2^2:2:1$ to display each grayscale level by selecting a subframe period during which light is emitted (see FIG. 5A). Specifically, if no light is emitted in all the periods, a first grayscale level (black: luminance 0) is displayed, while if light is emitted in all the periods, a 64th grayscale level (white: luminance 63) is displayed. If the light emitting periods having lengths $2^4$, $2^3$, $2^2$, and 1 are selected, a 30th grayscale level is displayed. Among the 64 grayscale levels from luminance 0 to luminance 63, $2^4+2^3+2^2+1=29$, that is, the 30th grayscale level (luminance 29) is displayed.

Further, in a lower bit, that is, in a subframe period with a short light emitting time, it is necessary to stop light emission before the next subframe period starts. Therefore, one row selection period is divided into a plurality of sub-horizontal periods (see FIG. 5B, in FIG. 5B, one row selection period is divided into two sub-horizontal periods), writing of a video signal is performed in a certain sub-horizontal period while erasing is performed in another sub-horizontal period. Each of the writing and the erasing is performed in a required row at a required timing to control a light emitting period in each bit.

In the case where a display device is driven by using the digital time grayscale method described in Patent Document 1, an active matrix type pixel may be driven by two values of white display and black display. Therefore, it is highly advantageous that characteristic variations of thin film transistors (hereinafter referred to as TFTs) which form a pixel hardly affect display quality. On the other hand, writing operation, erasing operation and the like for controlling light emitting time are required, and the number of times of writing a video signal in one frame period increases. Accordingly, the operating frequency of a periphery driver circuit and power consumption increase. In addition, with increase in the number of grayscale levels, the number of the writing operations and the erasing operations usually increases and power consumption increases as well. The aforementioned organic EL display device and the like are expected to be mounted on a mobile phone, a PDA (personal digital assistant), a portable audio player and the like by taking advantage of light weight and thin shape. However, in such portable terminals, high power consumption may affect a continuous using time. Therefore, high power consumption is a critical problem.

In view of the aforementioned problems, the invention provides a display device which can reduce power consumption in the case of being driven by using the digital time grayscale method, and an electronic apparatus using the display device. Further, the invention provides a display device which can reduce power consumption in a display state which seems to be frequently used in an actual portable terminal, such as a text display, and an electronic apparatus using the display device.

According to the invention, a row in which all the pixels display black is focused on in a plurality of pixels arranged in matrix, and sampling of data which is to be inputted to the pixels arranged in the row is not performed. Then, in a period during which the data sampling is not performed, the operation of a shift register in a source driver and sampling operation of a video signal in a first latch circuit are stopped. Moreover, according to the invention, when a multi-grayscale display is performed by using the digital time grayscale method, a driving method is used, where one horizontal period is divided into a plurality of (for example, two) sub-horizontal periods, writing of a video signal is performed in one sub-horizontal period, and erasing is preformed in the other sub-horizontal period. In the driving method, a video signal and an erasing signal are alternately outputted to a source signal line. In other words, immediately before writing a video signal to a pixel of a certain row, an erasing signal is certainly outputted to all the source signal lines. The erasing signal inputted immediately before is used in the pixels arranged in the row to display black instead of the video signal for displaying black. According to the invention having the aforementioned characteristics, operation of the source driver can be temporarily stopped to reduce power consumption. In particular, since the invention can stop the operation of the source driver which consumes much power in the display device, power consumption can be reduced dramatically.

A display device of the invention has a display portion having a plurality of pixels arranged in matrix, a shift register for outputting a sampling pulse, and a latch circuit for sampling video signals (all the video signals) in accordance with the sampling pulse, a line buffer circuit for holding video signals (one-row video signals) outputted to each of the plurality of pixels arranged in the same row, and a test circuit for testing the video signals (one-row video signals) held in the line buffer circuit. When the video signals (one-row video signals) are detected to be specific video signals (one-row video signals), the test circuit outputs a control signal so that the shift register stops the output of the sampling pulse to the plurality of pixels arranged in the row.

A display device of the invention has a display portion having a plurality of pixels arranged in matrix, a shift register for outputting a sampling pulse, and a latch circuit for sampling video signals (all the video signals) in accordance with the sampling pulse, a line buffer circuit for holding video signals (one-row video signals) outputted to each of the plurality of pixels arranged in the same row, a test circuit for testing the video signals (one-row video signals) held in the line buffer circuit, and a controller circuit for outputting a control signal to the shift register. When the video signals (one-row video signals) are detected to be specific video signals (one-row video signals), the test circuit outputs a control signal to the controller circuit so that the shift register stops the output of the sampling pulse to the plurality of pixels arranged in the row.

A display device of the invention has a display portion having a plurality of pixels arranged in matrix, a shift register for outputting a sampling pulse, and a latch circuit for sampling video signals (all the video signals) in accordance with the sampling pulse, a first line buffer circuit for holding video signals (one-row video signals) outputted to each of the plurality of pixels arranged in the same row, a second line buffer circuit for transferring the video signals (one-row video signals) held in the first line buffer circuit, holding the video signals (one-row video signals) held in the first line buffer circuit and outputting the video signals (one-row video signals) held in the first line buffer circuit to the display portion, a test circuit for testing the video signals (one-row video signals) held in the first line buffer circuit, and a controller circuit for outputting a control signal to the shift register. When the video signals (one-row video signals) are detected to be specific video signals (one-row video signals), the test circuit outputs a control signal to the controller circuit so that the shift register stops the output of the sampling pulse to the plurality of pixels arranged in the row, and the test circuit outputs a control signal to the second line buffer circuit so as to stop the transfer of the video signals (one-row video signals) from the first line buffer circuit to the second line buffer circuit.

The display portion included in the invention has a plurality of gate signal lines, a first gate driver and a second gate driver, in which an n-th stage output (n is a natural number) of the first gate driver and an n-th stage output of the second gate driver control an n-th gate signal line. Moreover, an output terminal of each stage of the first gate driver and the second gate driver has a selection circuit which determines whether the signal output is permitted or not. Note that the selection circuit is, for example, a tri-state buffer.

Further, the specific video signal is a video signal for displaying black in the pixel. In addition, the specific video signal is a video signal for displaying white in the pixel. In the display device of the invention having the aforementioned configuration, each of the plurality of pixels has a light emitting element and a plurality of transistors. The invention also provides an electronic apparatus using the display device having the aforementioned configuration.

According to the invention having the aforementioned characteristics, the operation of the source driver can be temporarily stopped to reduce power consumption. In particular, since the source driver consumes much power in the display device, power consumption can be reduced dramatically according to the invention which can stop the operation of the source driver.

Moreover, according to the invention having the aforementioned characteristics, in the case of repeatedly displaying a still image having a pattern which is displayed in an almost fixed portion in a display area, such as a text display, the number of the sampling operations of video signals can be dramatically reduced in the source driver which consumes relatively high power in a panel. Therefore, low power consumption can be realized not only in standby mode but also in a practical application to provide a display device and an electronic apparatus which meet a request such as long continuous use which is required for portable information terminals. Such an effect is very useful for electronic apparatuses such as portable terminals in which power consumption directly affects the continuous using time.

DETAILED DESCRIPTION OF THE INVENTION

The invention will be fully described by way of Embodiment Modes and Embodiments. Note that the invention is not limited to the following descriptions, and it is to be understood that various changes and modifications will be apparent to those skilled in the art. Therefore, unless otherwise such changes and modifications depart from the scope of the invention, they should be construed as being included therein.

Figure 6A:
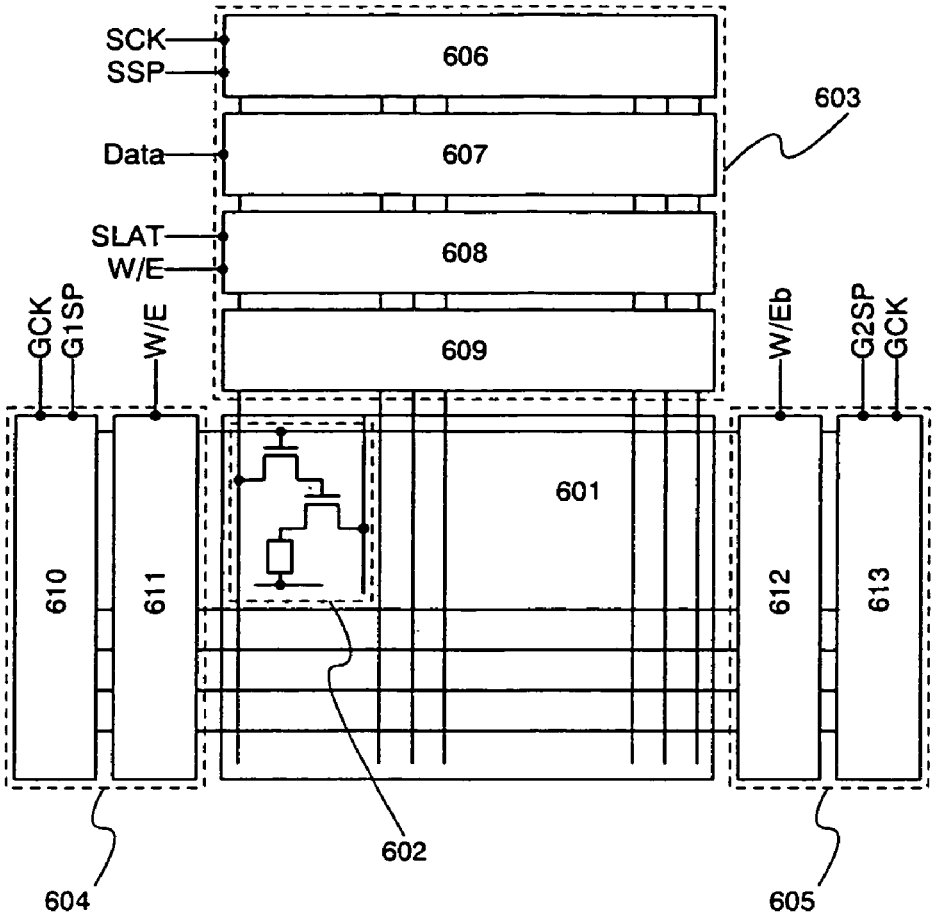
FIGS. 6A and 6B are diagrams each showing a display device of the invention.

A configuration of an active matrix display device of the invention is described with reference to FIG. 6A. In a pixel portion 601, an active matrix pixel 602 surrounded by a dotted frame is arranged in matrix. At the periphery of the pixel portion 601, a source driver 603, a gate driver for writing 604 and a gate driver for erasing 605 are arranged.

The source driver 603 has a shift register 606, a first latch circuit 607, a second latch circuit 608 and a level shifter/buffer 609. The gate driver for writing 604 has a shift register 610 and a level shifter/buffer 611 while the gate driver for erasing 605 similarly has a shift register 613 and a level shifter/buffer 612.

Figure 6B:
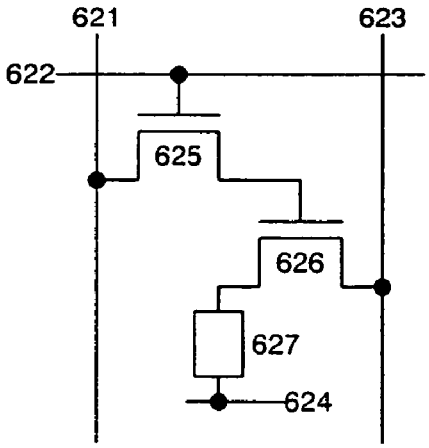
Figure 7:
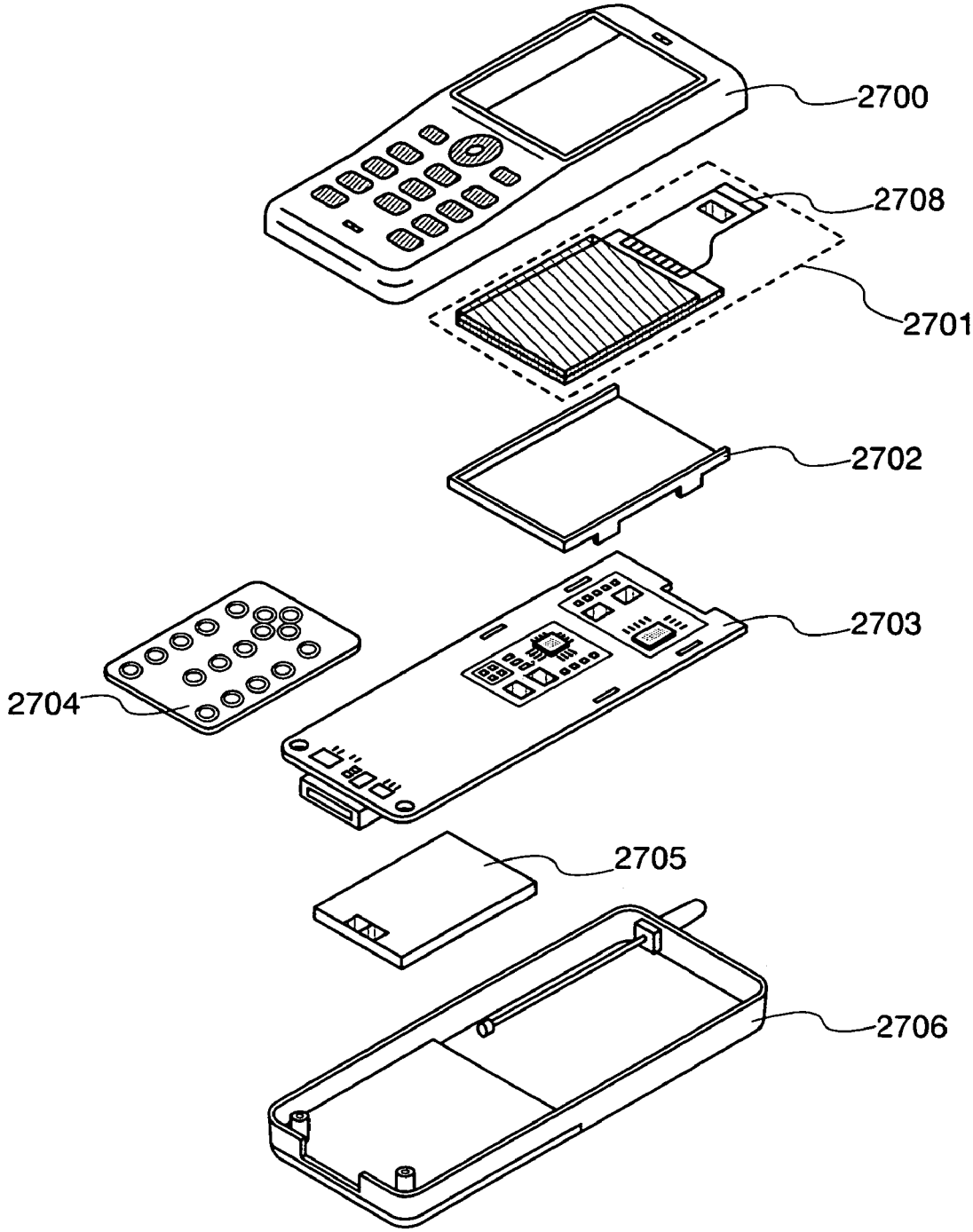
FIG. 7 is a view showing an electronic apparatus using a display device of the invention.

Next, further details about the active matrix pixel 602 are described with reference to FIG. 6B. Each pixel has a source signal line 621, a gate signal line 622, a current supply line 623, an opposite electrode 624, a switching TFT 625, a driving TFT 626 and a light emitting element 627.

The pixel is driven in different manners depending on the conductivity of the TFTs which form the pixel and a current direction flowing to the light emitting element 627. This embodiment mode describes, for example, a configuration in which the switching TFT 625 is an N-channel TFT, the driving TFT 626 is a P-channel TFT, and current flows in the light emitting element 627 from the current supply line 623 kept at a high potential to the opposite electrode 624 kept at a low potential. Circuits described hereinafter operate on the same logic as the pixel described herein. However, it is needless to say that the invention may be similarly applied to the case of driving pixels having configurations other than those described herein by changing signal logic and power supply relationship, and the conductivity of TFT and the like are not limited to those shown herein.

In a row in which the pixel is not selected, the gate signal line 622 is at Low level and the switching TFT 625 is in an OFF state. On the other hand, in a row in which the pixel is selected, the gate signal line 622 is at High level and the switching TFT 625 is in an ON state to write a potential of the source signal line 621 into the gate electrode of the driving TFT 626. Herein, in the case where the potential of the source signal line 621 is at High level, the driving TFT 626 is in an OFF state so that no current flows to the light emitting element 627 and the active matrix pixel 602 displays black. On the other hand, in the case where the potential of the source signal line 621 is at Low level, the driving TFT 626 is in an ON state so that current flows to the light emitting element 627 and the active matrix pixel 602 displays white. Note that although not specifically shown in FIG. 6, a video signal that has been written to the gate electrode of the driving TFT 626 is preferably held in a certain period by using a storage capacitor and the like. Therefore, after the gate signal line 622 is brought into a non-selective state, the ON or OFF state of the driving TFT 626 can be held to hold a black or white display state.

Next, operation of the display device of the invention is described. More specifically, operation of the display device of the invention in the case where one horizontal period is divided into a plurality of sub-horizontal periods is described.

In the source driver 603, the shift register 606 outputs sampling pulses sequentially from the first stage in accordance with a clock signal (SCK) and a start pulse (SSP). By the sampling pulses outputted from the shift register 606, a sampling of a video signal (Data) is performed in the first latch circuit 607. In a stage of the first latch circuit 607, where the sampling of the video signal is completed, the obtained video signal is held in a memory portion provided in the first latch circuit 607 until the sampling is completed in a last stage. After completing the output of the sampling pulses from the last stage of the shift register 606 and completing the sampling in all the stages of the first latch circuit 607, one-row data held in the first latch circuit 607 is simultaneously transferred to the second latch circuit 608 in accordance with a latch pulse (SLAT). After that, an amplitude conversion is performed in the level shifter/buffer 609 if necessary to charge and discharge the source signal line 621 in accordance with the video signal. A write erase selection signal (hereinafter referred to as a W/E signal) selects a mode in which the source signal line 621 is charged and discharged in accordance with the video signal or a mode in which signals for erasing are outputted to all the source signal lines 621.

On the other hand, in the gate driver for writing 604, the shift register 610 outputs row selection pulses sequentially from the first stage in accordance with a clock signal (GCK) and a start pulse (G1SP). The row selection pulse undergoes amplitude conversion in the level shifter/buffer 611 if necessary to select the gate signal line 622 sequentially from a first row. Similar operation as that of the gate driver for writing 604 is performed in the gate driver for erasing 605.

Herein, the gate driver for writing 604 selects, at a desired timing, the gate signal line 622 of the row to which a video signal is written while the gate driver for erasing 605 selects, at a desired timing, the gate signal line 622 of the row where erasing is performed. Therefore, the gate signal line 622 is selected at different timings by the gate driver for writing 604 and the gate driver for erasing 605. Thus, when one of the gate driver for writing 604 and the gate driver for erasing 605 charges and discharges the gate signal line 622, it is required to float the buffer output so that the other does not interrupt the operation. The operation is performed by using the W/E signal and an inverted signal thereof (hereinafter referred to as a W/Eb signal). For example, in a period in which the W/E signal is active, the source driver 603 outputs a video signal to the source signal line 621, the gate driver for writing 604 outputs a pulse and the output of the gate driver for erasing 605 is in a floating state in all the stages. Therefore, the selection of the gate signal line 622 depends on the gate driver for writing 604. On the other hand, in a period in which the W/Eb signal is active, the source driver 603 outputs an erasing signal to all the source signal lines 621 (according to the aforementioned pixel configuration, the source signal line 621 is fixed at High level similarly to the case of writing black), the gate driver for erasing 605 outputs a pulse and the output of the gate driver for writing 604 is in a floating state in all the stages. Therefore, the selection of the gate signal line 622 depends on the gate driver for erasing 605.

Figure 5A:
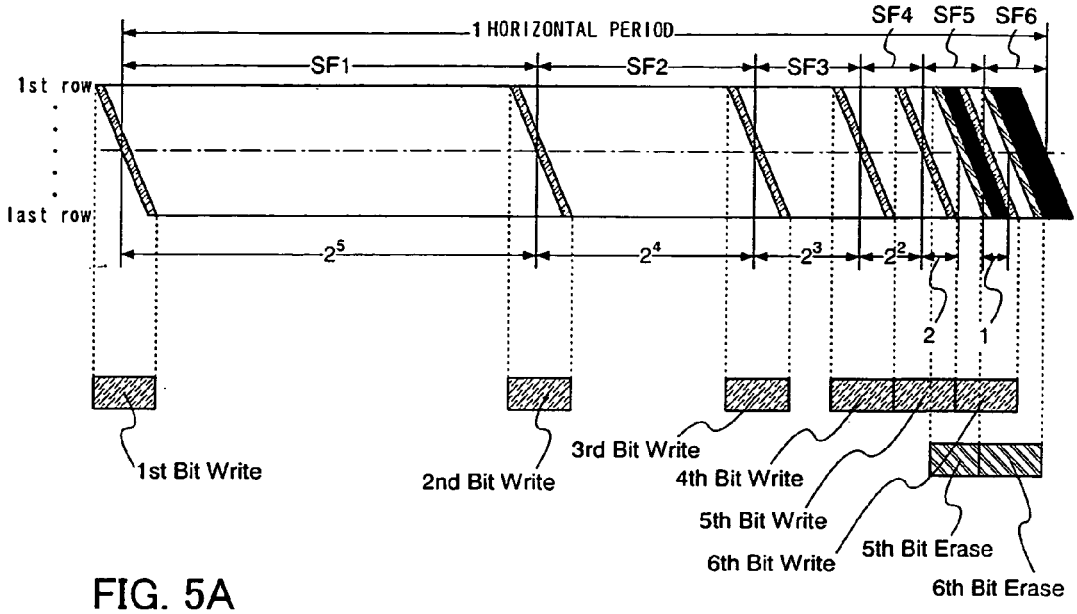
FIGS. 5A and 5B are diagrams each describing a digital time grayscale method.
Figure 5B:
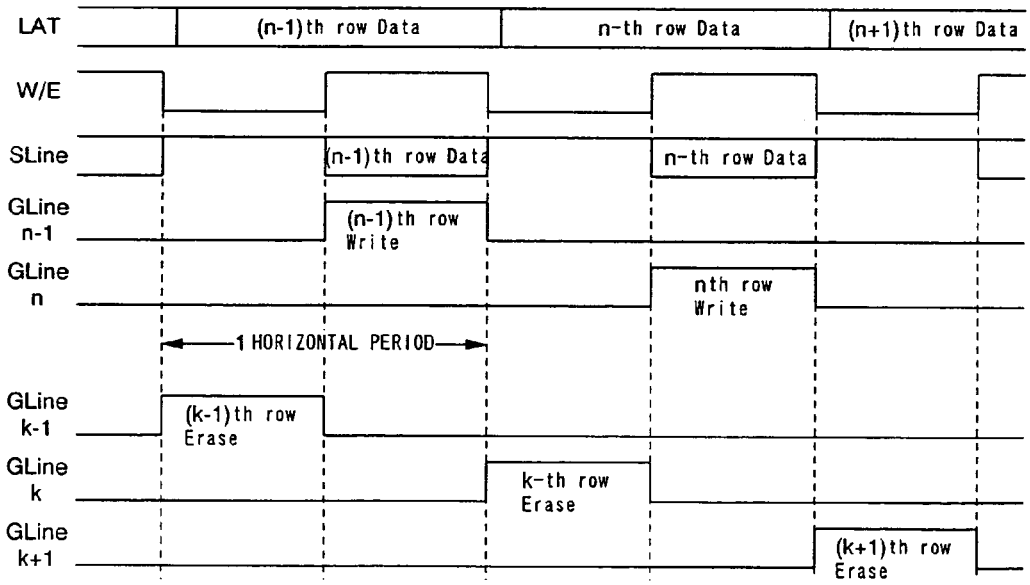

The operation of the display device of the invention is briefly described above. According to FIG. 5B, in a source signal line (SLine), a period for outputting data of a certain row and a period in which all the source signal lines are fixed at High level as a signal for erasing appear alternately. That is, because of an erasing scanning of a certain row, a state in which all the source signal lines are fixed at High level appears once in one horizontal period.

Figure 1:
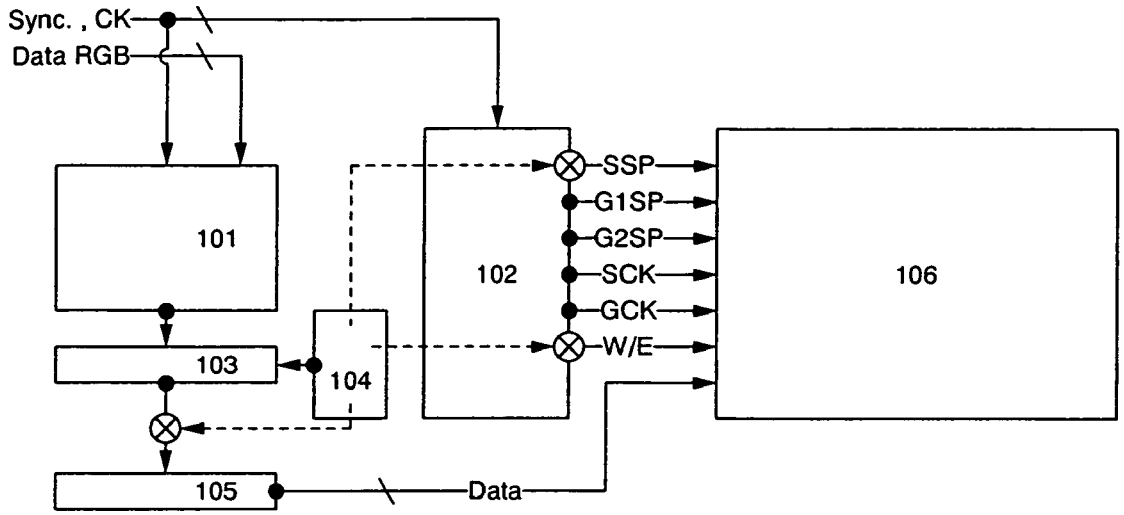
FIG. 1 is a diagram showing a display device of the invention.

Next, a configuration of a display device of the invention, which includes a display portion and an external controller portion, is described with reference to FIG. 1. The external controller portion has a frame memory 101, a timing controller 102, a first line buffer circuit 103, a second line buffer circuit 105 and a test circuit 104. These circuits generate various control signals to supply the generated various control signals to a display portion 106. Note that the external controller portion is not limited to the aforementioned configuration and description of a power supply system such as a DC/DC converter is omitted. Herein, the frame memory 101 is a memory for holding a video signal which is required to display one frame while the line buffers 103 and 105 are memories for holding a video signal which is required to display one row. Herein, a time grayscale method is used as a driving method, therefore, one-row video signals related to a certain bit among video signals required to display one row is held in the line buffers. However, the video signal held in the line buffer at a time is not limited to be the aforementioned amount of data, and a configuration may be allowed in which more video signals are held to sequentially read as much data as necessary at a required timing.

Subsequently, operation of the display device of the invention having the aforementioned configuration is described. As a signal used for driving the display device, there are a reference clock signal (CK), a synchronization signal (Sync), video signals for each of RGB (Data RGB). These signals are supplied from outside so that the reference clock signal (CK) and the synchronization signal (Sync) are inputted to the timing controller 102 to generate various control signals (in FIG. 1, SSP, G1SP, G2SP, SCK, GCK, W/E and the like) which are required for driving the display device. Moreover, the reference clock signal (CK) is also used for timing controlling of writing/reading of the frame memory 101 and the like.

On the other hand, video signals are written in the frame memory 101 which operates at a timing in accordance with the reference clock signal (CK), and rearranged in the frame memory 101 in the input order in accordance with the digital time grayscale method. Then, one-row video signals are read from the frame memory 101 to be transferred to the first line buffer circuit 103. At this time, the one-row video signals read from the frame memory 101 are tested by the test circuit 104 whether all the video signals of one row are video signals which display black. Herein, if a signal which displays white is included even for one dot, the video signals are transferred to the second line buffer circuit 105 and inputted to the display portion 106.

In the case where all the video signals of one row held in the first line buffer circuit 103 display black, the test circuit 104 outputs a control signal for stopping the input of a source driver start pulse (SSP) and a write erase selection signal (W/E signal) to the display portion 106, and a control signal for stopping the transfer of the video signal from the first line buffer circuit 103 to the second line buffer circuit 105. Therefore, the source driver in the display portion 106 does not perform the sampling operation of the row since no start pulse (SSP) is inputted to the shift register. Further, the video signal written in the second line buffer circuit 105 is also not changed from that of the previous row.

Figure 2A:
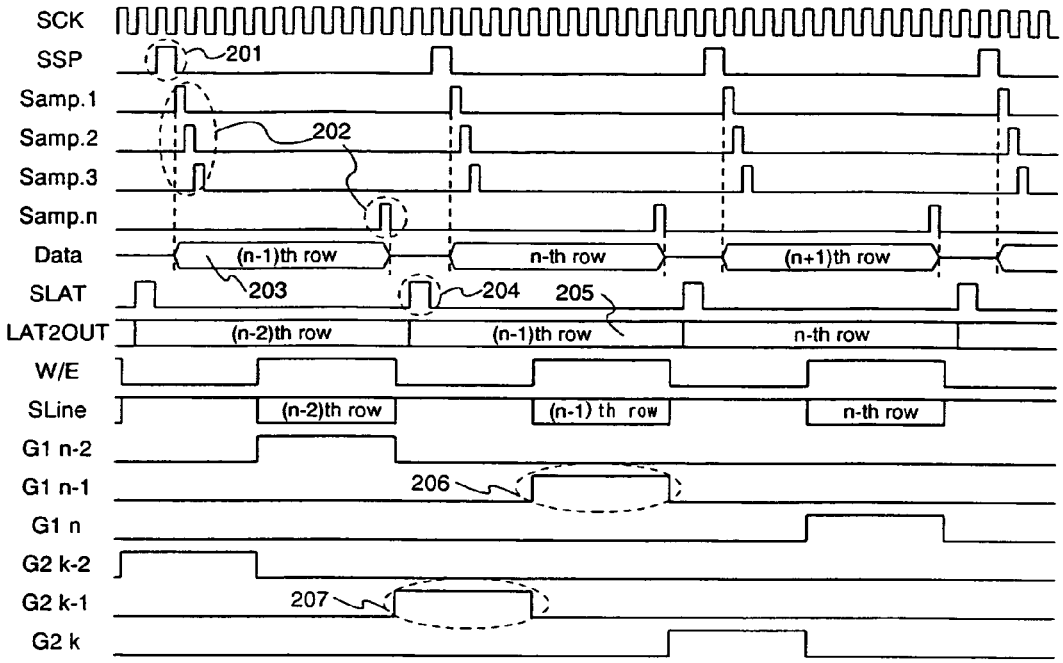
FIGS. 2A and 2B are timing charts each describing operation of a display device of the invention.

Next, description is made with reference to a timing chart shown in FIG. 2A. FIG. 2A shows a normal display timing. In accordance with the clock signal (SCK) and a start pulse (SSP) 201, sampling pulses (Samp) 202 are sequentially outputted to perform a sampling of a video signal 203 in accordance with a timing at which the sampling pulses 202 are outputted. Herein, a sampling of video signals of an (n−1)th row is performed by the sampling pulses 202. Subsequently, when a latch pulse (SLAT) 204 is inputted, the sampled video signals are simultaneously transferred to the second latch circuit. Herein, the second latch circuit outputs all the video signals of the (n−1)th row (LAT2OUT). Then, in a period in which the W/E signal is at High level, the video signal is outputted to the source signal line (SLine) while in a period in which the W/E signal is at Low level, the erasing signal is outputted, that is, the source signal line (SLine) is fixed at High level. In the gate drivers, the (n−1)th row is selected (206) by the gate driver for writing 604 and the video signal is inputted to pixels of the (n−1)th row. On the other hand, a (k−1)th row is selected (207) by the gate driver for erasing 605 and the erasing signal is inputted to pixels of the (k−1)th row. The aforementioned operations are repeated in the n-th row, an (n+1)th row and later as well as a k-th row, a (k+1)th row and later to complete the operation for one subframe.

Figure 2B:
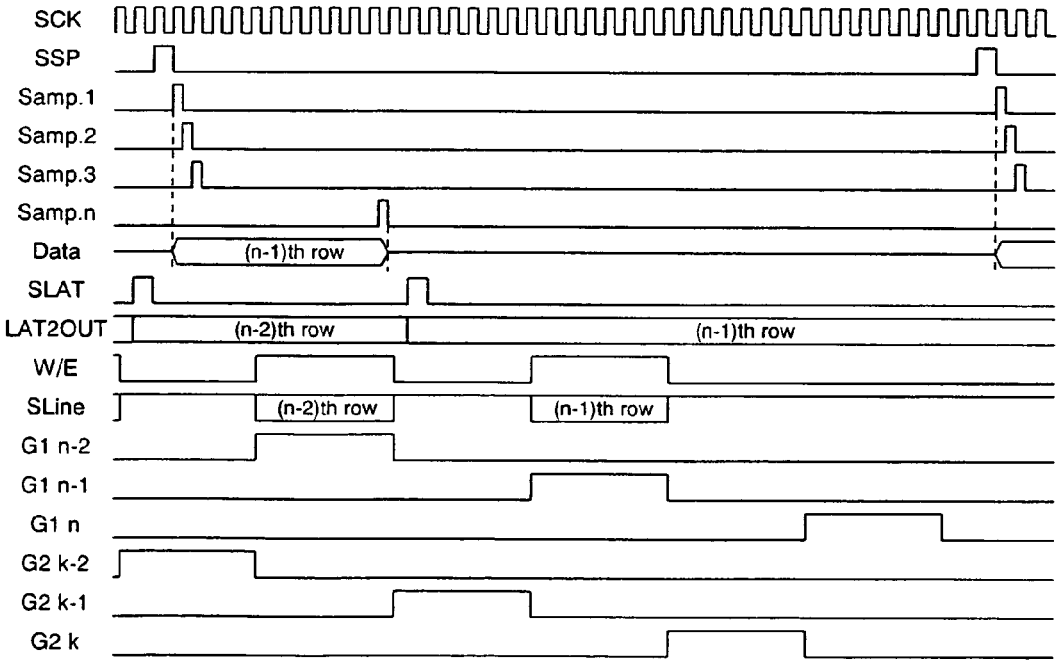

FIG. 2B shows a state in which sampling operation is stopped in a certain row in accordance with the invention. In the (n−1)th row, a video signal is inputted to take the video signal in accordance with a sampling pulse. Therefore, in the source signal line (SLine), the video signal of the (n−1)th row is outputted. Then, in the case where all the pixels of the n-th row and the (n+1)th row display black, the output of the start pulse (SSP) and the video signal (Data) is forcibly stopped by the test circuit 104 so as not to perform the sampling operation. Therefore, the second latch circuit 608 continuously outputs the video signal of the (n−1)th row (LAT2OUT). On the other hand, the W/E signal is also stopped by the test circuit 104 in that period to be fixed at Low level. Therefore, the video signal is not outputted to the source signal line (SLine) and the erasing signal is continuously inputted thereto. Gate signal lines of the (n−1)th row and the n-th row are brought into a selective state at a predetermined timing as usual so that an erasing signal at High level (equivalent to a black-display signal) outputted to the source signal line (SLine) is inputted to the pixel to display black. After that, in the case where video signals of the (n+2)th row and later are inputted as usual, the start pulse (SSP) or the W/E signal is inputted at a predetermined timing, therefore, the sampling and the charging and discharging of the source signal line (SLine) are performed normally so that a predetermined video signal is inputted to each pixel to display a pattern.

As set forth above, according to the invention, in a portion in which the sampling operation of signals is no required, such as a background portion of the text display, operation such as to actively stop sampling operation of the source driver can be realized in a small-sized circuit configuration. In general, a source driver to perform a sampling of a video signal is a circuit with a high operating frequency in a display device, and effectively stopping unnecessary operation of the circuit greatly contributes to low power consumption.

Note that although the operation in a black-display region is shown the most simple example in this embodiment mode, by using a similar test circuit, it is also possible to detect, for example, a white-display region and to stop sampling operation. In that case, a state in which a source signal line is fixed at Low level may be held. Specifically, in the case where: all the video signals display white in a plurality of continuous rows, the source signal line is fixed at Low level in the first row. Then, the W/E signal is fixed at High level so that the erasing signal is not inputted to the source signal line. In a subsequent row in which white display continues, a white-display signal, that is, Low level signal may be continuously inputted from the source signal line which is fixed at Low level to pixels of a predetermined row.

Further, in this embodiment mode, although the W/E signal is described using only one system for simplicity, different systems are required for a W/E signal used for selection of writing or erasing operation of a source driver side, and a W/E signal used for the selection of a gate driver for writing or a gate driver for erasing. However, a way of supplying signals to the display portion, which is not related to the object of the invention, is not limited especially. Signals may be externally inputted by a plurality of systems in advance or generated from one W/E signal.

Note that in the invention, as one mode of display devices, an organic EL display device is described as an example. However, the invention is not limited by an element which forms a pixel, and it is needless to say that the invention can be widely applied to a liquid crystal display device, a PDP, an FED and the like.

Embodiment 1

In this embodiment, a configuration example of a driver circuit of the display device of the invention is described.

Figure 3:
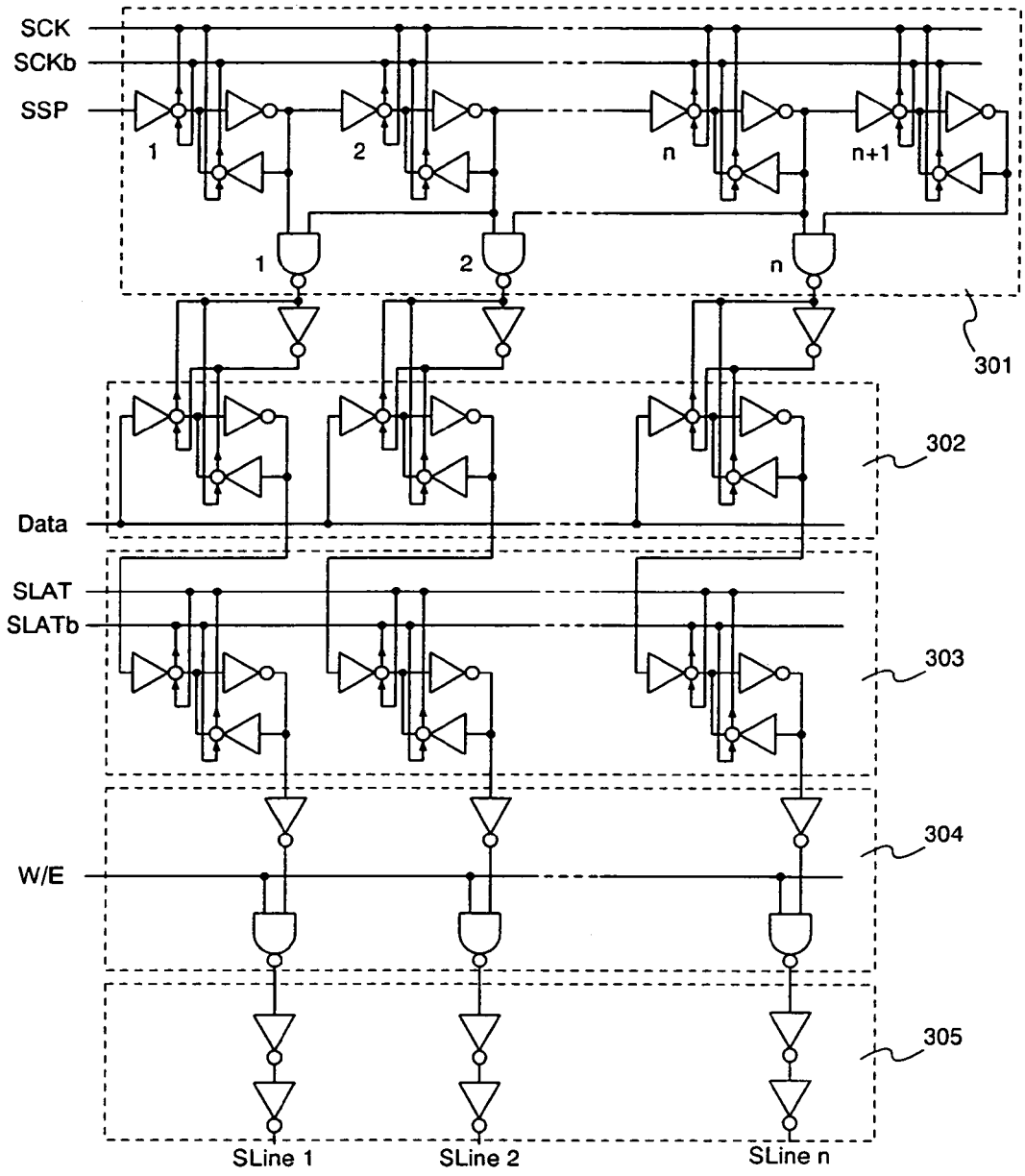
FIG. 3 is a diagram showing a display device of the invention.

First, a configuration example of a source driver is described with reference to FIG. 3. The source driver has a shift register 301, a first latch circuit 302, a second latch circuit 303, a writing erasing selection circuit 304 and a buffer circuit 305.

The shift register 301 outputs sampling pulses sequentially in accordance with clock signals (SCK, SCKb: SCKb is an inverted signal of SCK) and a start pulse (SSP). The first latch circuit 302 performs a sampling of a video signal (Data) in accordance with the sampling pulses outputted from the shift register 301. After completing the sampling of the video signal in all stages of the first latch circuit 302, when latch pulses (SLAT, SLATh: SLATh is an inverted signal of SLAT) are inputted, the video signals held in the first latch circuit 302 are simultaneously transferred to the second latch circuit 303. In the case where a W/E signal is active (herein, in the case of being at High level), the writing erasing selection circuit 304 inverts the video signal to output it. On the other hand, in the case where the W/E signal is at Low level, the write erase selection circuit 304 outputs a High level signal regardless of the video signal. Then, charge and discharge of source signal lines (SLine 1 to SLine n) are performed through the buffer circuit 305.

Figure 4A:
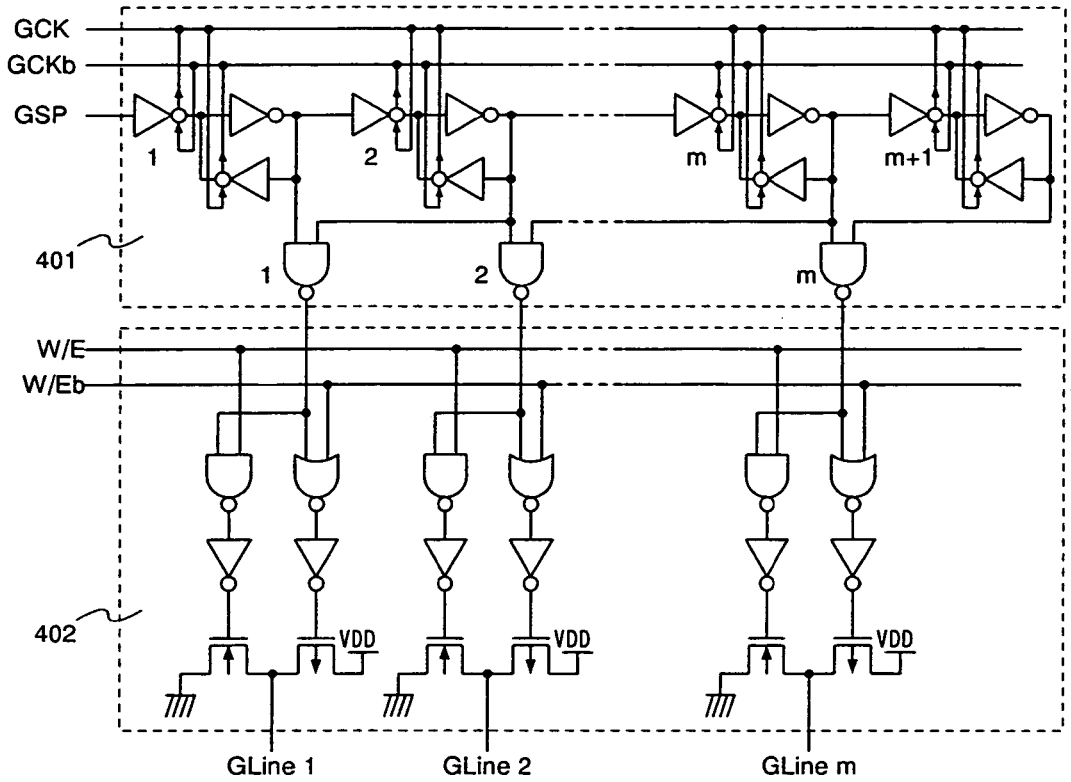
FIGS. 4A and 4B are diagrams each showing a display device of the invention.

Next, a configuration example of a gate driver is described with reference to FIG. 4A. The gate driver has a shift register 401 and a buffer circuit 402. The buffer circuit 402 uses a tri-state buffer using a W/E signal. Herein, in the case where the W/E signal is at High level, the tri-state buffer functions as an inverter while in the case where the W/E signal is at Low level, the output of the tri-state buffer is in a floating state. As described above, the selection of the gate signal line is performed by a gate driver for writing and a gate driver for erasing in writing operation or erasing operation respectively, therefore, the tri-state buffer is provided so that selection operation of the gate signal line by one of the two gate drivers is not interrupted by the other.

The shift register 401 outputs row selection pulses sequentially in accordance with clock signals (GCK, GCKb: GCKb is an inverted signal of GCK) and a start pulse (G1SP). The buffer circuit 402 is controlled by the W/E signal and the W/Eb signal (an inverted signal of W/E), and in the case where the W/E signal is active, the row selection pulse is inverted and sequentially outputted to gate signal lines (GLine 1 to GLine m). In the case where the W/E signal is at Low level, the output of the buffer circuit 402 is in a floating state.

Figure 4B:
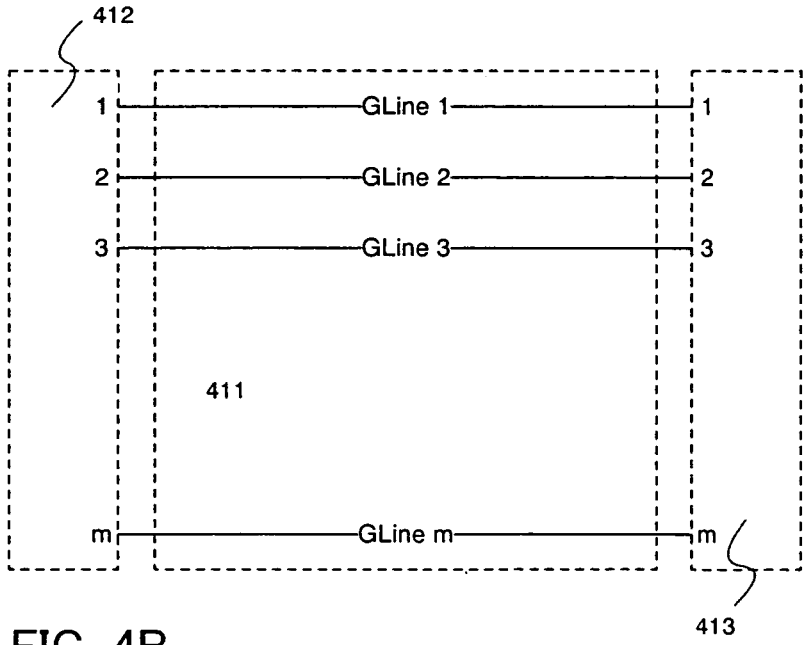

A gate driver for writing 412 and a gate driver for erasing 413 are positioned opposite to each other with a pixel portion 411 interposed therebetween (see FIG. 4B). At this time, the W/E signal is outputted to one of the gate driver for writing 412 and the gate driver for erasing 413, an inverted signal of the W/E signal is outputted to the other thereof. Thus, when a tri-state buffer included in one gate driver is active to charge and discharge the gate signal line, the output of the tri-state buffer included in the other gate driver is in a floating state. Therefore, each other's selection operation of the gate signal line for writing or erasing is not interrupted.

Note that although a level shifter is not provided in the configuration of this embodiment, it may be provided appropriately if necessary.

Embodiment 2

One embodiment of an electronic apparatus using the display device of the invention is described with reference to FIGS. 7 and 8A to 8F. Shown as an example of the electronic apparatus here is a mobile phone which has housings 2700 and 2706, a panel 2701, a housing 2702, a printed wiring board 2703, an operation button 2704 and a battery 2705 (see FIG. 7). The panel 2701 has a pixel portion in which a plurality of pixels are arranged in matrix. The panel 2701 is detachably mounted in the housing 2702 while the housing 2702 is attached to the printed wiring board 2703. The shape and size of the housing 2702 are changed appropriately in accordance with an electronic apparatus in which the panel 2701 is mounted. A plurality of semiconductor devices (also referred to as IC chips) which are packaged are mounted on the printed wiring board 2703. The plurality of semiconductor devices mounted on the printed wiring board 2703 are equivalent to a frame memory, a timing controller, a line buffer circuit, a test circuit, a central processing unit (CPU), a power supply circuit, an image processing circuit, a sound processing circuit, a transmit/receive circuit, a time detection circuit, a correction circuit, a temperature sensing circuit and the like, which are components of the display device of the invention.

The panel 2701 is integrated with the printed wiring board 2703 through a connection film 2708. The panel 2701, the housing 2702 and the printed wiring board 2703 are put inside the housings 2700 and 2706, as well as the operation button 2704 and the battery 2705. The pixel portion included in the panel 2701 is arranged so as to be seen from an opening window provided in the housing 2700.

Note that the housings 2700 and 2706 show one example of the exterior shape of mobile phones, an electronic apparatus related to this embodiment can be changed to various modes in accordance with the function and application. Therefore, examples of modes of electronic apparatuses are described hereinafter with reference to FIGS. 8A to 8F.

Figure 8A:
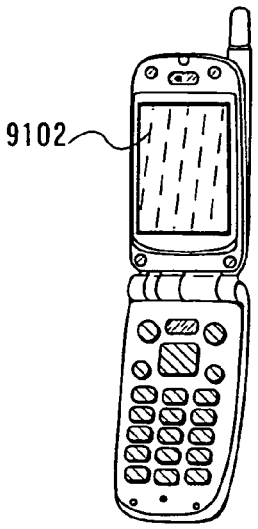
FIGS. 8A to 8F are views each showing an electronic apparatus using a display device of the invention.
Figure 8B:
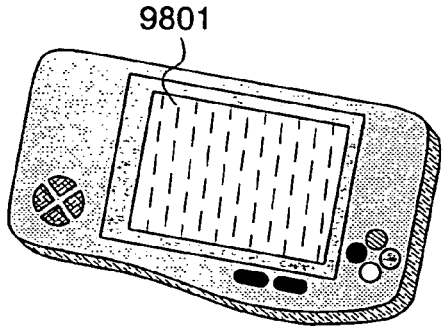
Figure 8C:
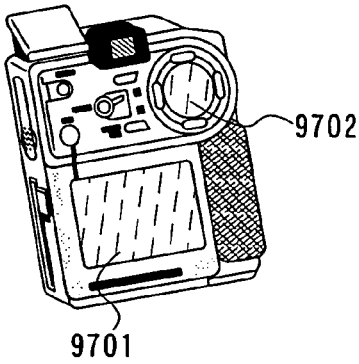
Figure 8D:
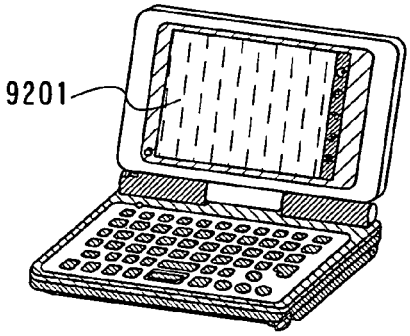
Figure 8E:
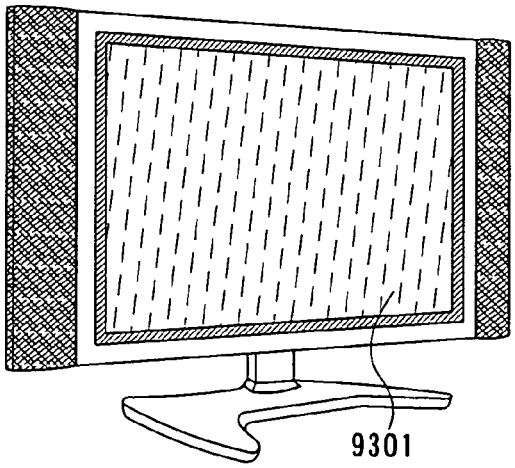
Figure 8F:
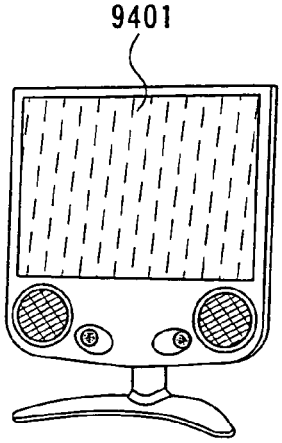

A mobile phone device includes a pixel portion 9102 and the like (see FIG. 8A). A portable game device includes a pixel portion 9801 and the like (see FIG. 8B). A digital video camera includes pixel portions 9701, 9702 and the like (see FIG. 8C). A portable information terminal includes a pixel portion 9201 and the like (see FIG. 8D). A television device includes a pixel portion 9301 and the like (see FIG. 8E). A monitor device includes a pixel portion 9401 and the like (see FIG. 8F).

The invention can be applied to various electronic apparatuses such as a television device (also referred to as a TV or a television receiver), a digital camera, a mobile phone set (also referred to as a mobile phone device or a mobile phone), a portable information terminal such as a PDA, a portable game device, a monitor device for computer (also referred to as a monitor), a sound reproducing device such as a car audio, and a home game device. Operation of a source driver can be stopped temporarily by applying the display device of the invention, and thus an electronic apparatus in which power consumption is reduced can be provided. In particular, the invention can stop operation of the source driver which consumes much power in the display device, leading to dramatic reduction in power consumption. Such an effect is very useful for electronic apparatuses such as portable terminals in which power consumption directly affects a continuous using time.

This application is based on Japanese Patent Application serial no. 2004-339682 filed in Japan Patent Office on 24th, Nov. 2004, the entire contents of which are hereby incorporated by reference.

What is claimed is:

1. A display device comprising:

a display portion comprising:

a plurality of pixels arranged in matrix, a shift register for outputting a sampling pulse, and a latch circuit for sampling a video signal in accordance with the sampling pulse;

a first line buffer circuit for holding the video signal outputted to a row of pixels of the plurality of pixels;

a second line buffer circuit for receiving the video signal from the first line buffer circuit, holding the video signal received from the first line buffer circuit, and outputting the held video signal to the display portion;

a test circuit for testing the video signal held in the first line buffer circuit; and a controller circuit for outputting a control signal to the shift register, wherein when the video signal is detected to be a specific video signal, the test circuit outputs to the controller circuit a first control signal so that the shift register stops outputting the sampling pulse corresponding to the row of pixels, and the test circuit outputs to the second line buffer circuit a second control signal so as to stop receiving the video signal from the first line buffer circuit.

2. The display device according to claim 1, wherein the display portion has a plurality of gate signal lines, a first gate driver, and a second gate driver, wherein both of an n-th stage output of the first gate driver and an n-th stage output of the second gate driver control a gate signal line of an n-th row, and wherein an output terminal of each stage of the first gate driver and the second gate driver has a selection circuit which determines whether an output of the signal is permitted or not, wherein n is a natural number.

3. The display device according to claim 2, wherein the selection circuit is a tri-state buffer.

4. The display device according to claim 1, wherein the specific video signal is a video signal by which the pixel displays black.

5. The display device according to claim 1, wherein the specific video signal is a video signal by which the pixel displays white.

6. The display device according to claim 1, wherein each of the plurality of pixels has a light emitting element.

7. The display device according to claim 1, wherein each of the plurality of pixels has a plurality of transistors.

8. An electronic apparatus using the display device according to claim 1.

9. The electronic apparatus according to claim 8, wherein the electronic apparatus is one of a mobile phone, a game device, a camera, a television device, and a monitor device.

10. A display device comprising:

a display portion comprising:

a plurality of pixels arranged in matrix;

a shift register for outputting a sampling pulse; and a latch circuit for sampling a video signal in accordance with the sampling pulse;

a first line buffer circuit for holding the video signal outputted to a row of pixels of the plurality of pixels;

a second line buffer circuit for receiving the video signal from the first line buffer circuit, holding the video signal received from the first line buffer circuit, and outputting the held video signal to the display portion; and a test circuit for testing the video signal held in the first line buffer circuit, wherein when the video signal is detected to be a specific video signal, the test circuit outputs a control signal so that the shift register stops outputting the sampling pulse corresponding to the row of pixels.

11. The display device according to claim 10, wherein the display portion has a plurality of gate signal lines, a first gate driver, and a second gate driver, wherein both of an n-th stage output of the first gate driver and an n-th stage output of the second gate driver control a gate signal line of an n-th row, and wherein an output terminal of each stage of the first gate driver and the second gate driver has a selection circuit which determines whether an output of the signal is permitted or not, wherein n is a natural number.

12. The display device according to claim 11, wherein the selection circuit is a tri-state buffer.

13. The display device according to claim 10, wherein the specific video signal is a video signal by which the pixel displays black.

14. The display device according to claim 10, wherein the specific video signal is a video signal by which the pixel displays white.

15. The display device according to claim 10, wherein each of the plurality of pixels has a light emitting element.

16. The display device according to claim 10, wherein each of the plurality of pixels has a plurality of transistors.

17. An electronic apparatus using the display device according to claim 10.

18. The electronic apparatus according to claim 17, wherein the electronic apparatus is one of a mobile phone, a game device, a camera, a television device, and a monitor device.

19. A display device comprising:

a display portion comprising:

a plurality of pixels arranged in matrix;

a shift register for outputting a sampling pulse; and a latch circuit for sampling a video signal in accordance with the sampling pulse;

a first line buffer circuit for holding the video signal outputted to a row of pixels of the plurality of pixels;

a second line buffer circuit for receiving the video signal from the first line buffer circuit, holding the video signal received from the first line buffer circuit, and outputting the held video signal to the display portion;

a test circuit for testing the video signal held in the first line buffer circuit; and a controller circuit for outputting a control signal to the shift register, wherein when the video signal is detected to be a specific video signal, the test circuit outputs to the controller circuit a control signal so that the shift register stops outputting the sampling pulse corresponding to the row of pixels.

20. The display device according to claim 19, wherein the display portion has a plurality of gate signal lines, a first gate driver, and a second gate driver, wherein both of an n-th stage output of the first gate driver and an n-th stage output of the second gate driver control a gate signal line of an n-th row, and wherein an output terminal of each stage of the first gate driver and the second gate driver has a selection circuit which determines whether an output of the signal is permitted or not, wherein n is a natural number.

21. The display device according to claim 20, wherein the selection circuit is a tri-state buffer.

22. The display device according to claim 19, wherein the specific video signal is a video signal by which the pixel displays black.

23. The display device according to claim 19, wherein the specific video signal is a video signal by which the pixel displays white.

24. The display device according to claim 19, wherein each of the plurality of pixels has a light emitting element.

25. The display device according to claim 19, wherein each of the plurality of pixels has a plurality of transistors.

26. An electronic apparatus using the display device according to claim 19.

27. The electronic apparatus according to claim 26, wherein the electronic apparatus is one of a mobile phone, a game device, a camera, a television device, and a monitor device.

* * * * *